US005788083A

United States Patent [19]

Krambrock

[11] Patent Number: 5,788,083

[45] Date of Patent: Aug. 4, 1998

[54] ELBOW/COUNTERCURRENT CLASSIFIER

[75] Inventor: Wolfgang Krambrock, Vogt, Germany

[73] Assignee: Zeppelin Schuettguttechnik Gmbh, Weingarten, Germany

[21] Appl. No.: 732,390

[22] PCT Filed: Apr. 26, 1995

[86] PCT No.: PCT/DE95/00575

§ 371 Date: Oct. 22, 1996

§ 102(e) Date: Oct. 22, 1996

[87] PCT Pub. No.: WO95/31294

PCT Pub. Date: Nov. 23, 1995

[30] Foreign Application Priority Data

May 13, 1994 [DE] Germany ..... 44 16 757.1

[51] Int. Cl.[6] ..... B07B 4/00; B07B 7/00

[52] U.S. Cl. ..... 209/139.1; 209/145; 209/154; 209/716

[58] Field of Search ..... 209/133, 138, 209/139.1, 142, 145, 146, 154, 715, 716

[56] References Cited

U.S. PATENT DOCUMENTS

| | | | |
|---|---|---|---|
| 3,441,131 | 4/1969 | Gebauer | 209/139.1 X |
| 4,872,973 | 10/1989 | Ikebuchi et al. | 209/716 |
| 5,201,422 | 4/1993 | Ihara et al. | 209/145 X |

FOREIGN PATENT DOCUMENTS

| | | | |
|---|---|---|---|
| 1905106 | 8/1970 | Germany . | |
| 2405298 | 8/1975 | Germany . | |
| 3540682 | 5/1987 | Germany . | |
| 4235260 | 4/1994 | Germany . | |
| 848093 | 7/1981 | U.S.S.R. | 209/139.1 |

OTHER PUBLICATIONS

W. Krambrock: "Möglichkeiten zum Abtrennen von Splittern Staub und Fäden aus Kunststoffgranulat". In: vt verfahrenstechik, 16, (1982), No. 7/8, pp. 640–648.

*Primary Examiner*—William E. Terrell
*Assistant Examiner*—Tuan N. Nguyen
*Attorney, Agent, or Firm*—Spencer & Frank

[57] ABSTRACT

The invention proposes an elbow/countercurrent classifier by means of which a pneumatically introduced bulk-material stream can be separated into coarse fractions and fine materials. In order to increase the efficiency of the classifier as regards the separating action, a wall profile which results in increased turbulence of the gas streams is selected, in particular, in the region of the acceleration section and of the classifying section which adjoins the latter at the bottom. This produces a rise in the air velocity in the vicinity of the wall and thus an air velocity which is constant over the cross section.

11 Claims, 2 Drawing Sheets

ELBOW/COUNTERCURRENT CLASSIFIER

The invention relates to an elbow/countercurrent classifier according to the preamble of claim 1.

PRIOR ART

So-called air classifiers are used for the dry classification of fine-grained solids. The separating characteristic is the final velocity at which the grains fall in the air. In particular, classifiers of this type may also be used for cleaning a quantity of bulk material which is present essentially in the form of granules and contains particles of different sizes. As a result of different production processes, bulk materials may have very different size distribution ranges. Plastics are provided in the form of granules which are mixed with abraded particles and/or with dust particles. If the size of the granule particles is in the order of magnitude of from approximately 2 to 5 mm for the diameter or the length of the granules, then, in contrast, the size of the dust particles is only, for example 50 μm. In the case of plastics granules, larger particles, which are also referred to as angel hair or streamers, are also present from time to time, and these may be in the form of disks, coils or spheres and have a diameter of from approximately 2 cm up to 10 cm. Such materials occur, in particular, in the case of pneumatic delivery. The granules delivered through the tube conduit rub along the tube, heat up and form adhering filaments or films which repeatedly tear away or become detached.

A known air classifier for treating such materials is described in DE 42 35 260 A1, further prior art being given in this document.

In order to treat such bulk materials, DE-OS 1 905 106 has disclosed a so-called elbow/countercurrent classifier in which the bulk material to be treated is fed to an elbow classifier via a delivery-gas stream. Here, in particular, the bulk material delivered downward in the delivery-gas stream in the elbow classifier is taken up by a separating-gas stream which is oriented in the opposite direction, deflects the delivery-gas stream upward and, in the process, carries along the lighter, smaller and, in particular, dustlike particles in the deflected delivery-gas stream, while heavier particles pass through the separating-gas stream, on account of the particle velocity and mass inertia, and are collected in the lower region of the classifier.

The reference source: Reprint from vt "Verfahrenstechnik" [Process engineering] 16 (1982) No. 7/8, pages 640 to 648 has disclosed an elbow/countercurrent classifier according to the preamble of claim 1 which likewise serves for treating a bulk-material stream. In this reference source, the elbow/countercurrent classifier is described as a very efficient means for separating off splinters, dust, filaments or the like from plastics granules. You is therefore expressly referred to the mode of operation, described in this reference source, of said elbow/countercurrent classifier.

It is already specified in this reference source, in the description of a further riser tube/gravity classifier, that the velocity profile in the interior of the tube varies over the tube cross section, the air velocity dropping toward zero, in particular, in the vicinity of the wall. Fine particles which pass into the vicinity of the wall thus drop into the coarse material if they are not picked up by the air turbulence and not transported back into the interior of the tube. This disadvantage is not stated explicitly in the elbow/countercurrent classifier described subsequently in this reference source since, in this case, high particle acceleration occurs inside the provided opening duct of the bulk-material delivery conduit, as a result of which particles above a specific size pass through the classifying section located upstream of the outlet mouth and are separated off in the bottom collecting container and discharged. All the smaller particles and filaments and strips are slowed down without any difficulty in the classifying section and discharged by the deflected air flow. The known elbow classifier thus solves to a satisfactory degree the problem of classifying the elements to be separated off.

ADVANTAGES OF THE INVENTION

The object of the invention is to improve the prior art known from the reference source "Verfahrenstechnik" . . . to the effect that even more efficient separation between larger particles and, in particular, plastics granules and the associated contaminants such as splinters, dust, filaments or the like is possible.

Taking an elbow/countercurrent classifier according to the preamble of claim 1 as the departure point, this object is achieved by the defining features of claim 1.

Advantageous developments and improvements of the countercurrent classifier as claimed in the main claim are specified in the subclaims.

The invention is based on the basic idea that classification, i.e. separation of various constituent parts, is only possible to a sufficient degree if all the regions of a bulk-material stream are accessible. It is, indeed, known from the reference source "Verfahrenstechnik" mentioned in the introduction that the air velocity of a delivery stream in a delivery tube drops toward zero in the vicinity of the wall. However, in an elbow/countercurrent classifier, this technical effect is disregarded in so far as the bulk-material delivery conduit passing into the classifier chamber from above is introduced concentrically, i.e. centrally, with the result that the falling bulk-material stream does not pass into the wall region of the classifier anyway since it is taken up beforehand by the rising separating-gas stream and treated. However, such a way of looking at the situation disregards the fact that the bulk-material stream is also subjected in the interior of the bulk-material delivery conduit to a velocity profile which prevents the desired acceleration of the particles at least in the respective wall region. The central tube introduced for forming an annular acceleration duct in the bulk-material delivery conduit produces a radially inner and a radially outer lateral cylinder surface, between which the described velocity profile is set up. Equally, the central tube, which is continued downward through the classifier, forms a desired annular cross section for the specific supply of the upwardly directed separating-gas stream to the opening region of the bulk material delivery conduit. This annular duct for the separating-gas stream also forms a radially inner and a radially outer lateral cylinder surface with a correspondingly encircling velocity profile.

The invention, then, selects, in particular on the radially inner lateral cylinder surface, both in the acceleration region of the bulk-material delivery conduit, said acceleration region being in the form of an annular duct, and preferably also in the annular flow duct of the separating-gas stream, a surface structure for the lateral cylinder surfaces which is intended to avoid the situation where the air velocity drops toward zero in the vicinity of the wall to the previous extent. In other words, the velocity profile of the air velocity within the given annular ducts- is to be such as to preclude the formation, in the wall region of the respective annular ducts, of any dead zones in which the granules can fall through. This is achieved, for example, in the prior art described in the reference source "Verfahrenstechniku" by a zig-zag classifier, i.e. the particles which are not taken up in the wall region by the air flow of the separating-gas stream are always deflected back into the gas stream.

The present invention pursues a different way of achieving this aim, in that the surface structure is formed such that increased turbulence is produced in the wall region, this increased turbulence resulting in a velocity profile of the air flows which is rectangular to the greatest possible extent. The zig-zag shape of the air classifier itself given in the reference source "Verfahrenstechnik" is provided as surface structure, for example, at a suitable location on the lateral cylinder surfaces in order to result in increased air turbulence, in particular, in the wall region.

In this manner, in the bulk-material delivery conduit, all the larger particles are also accelerated in the wall region, with the result that they are capable of passing through the separating-gas stream in the classifying zone. If such particles were not accelerated to the necessary degree, then, on account of their velocity being too low, they would be taken up by the separating gas stream and discharged upward out of the classifier. This would result in unnecessary losses of the granules to be collected in the lower region of the classifier.

Furthermore, the velocity profile achieved in the classifying section located beneath the outlet opening of the bulk-material delivery conduit also causes the lighter elements, which are to be discharged upward out of the classifier, located in the wall region to be taken up since there are no longer any dead zones in the wall regions. The efficiency of the elbow/countercurrent classifier is considerably improved in this manner.

Further details and advantages of the invention can be gathered from the exemplary embodiment which is described hereinbelow and from the drawings, in which:

FIG. 1 shows, in longitudinal cross section, an overall view of an elbow/countercurrent classifier, and FIG. 2 shows an enlarged illustration of the classifying zone of the classifier, the left-hand half of the Figure illustrating the prior art and the right-hand half of the Figure illustrating a design according to the invention.

DESCRIPTION OF THE EXEMPLARY EMBODIMENT:

Figure 1:
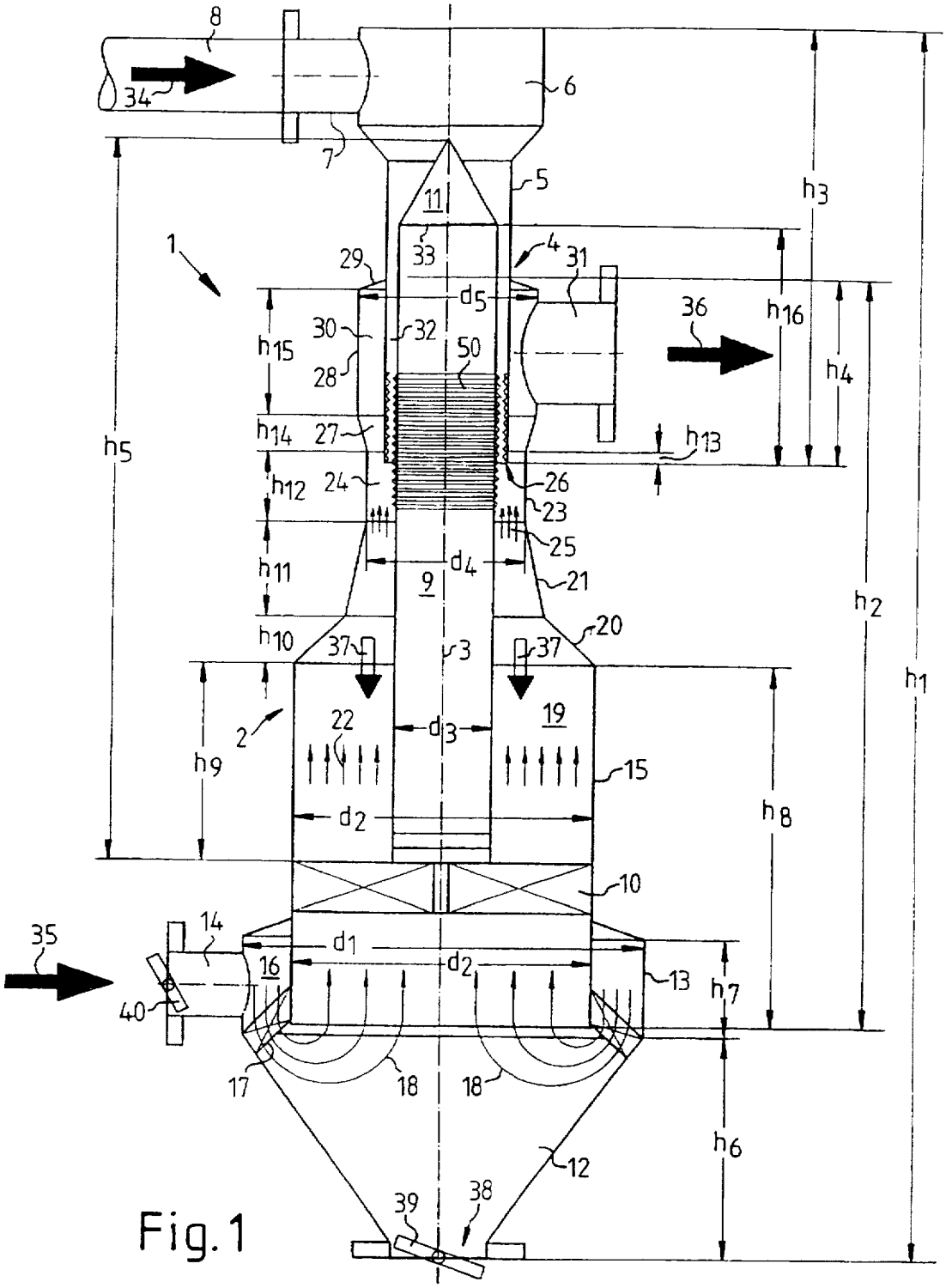

FIG. 1 illustrates an inventive elbow/countercurrent classifier 1 which comprises a vertically aligned cylindrical classifier cylinder 2 with a longitudinal axis of symmetry 3. The elbow/countercurrent classifier 1 as a whole is of a height $h_1$, and the classifier cylinder 2 is of a height $h_2$. Guided concentrically through the upper opening 4 of the classifier cylinder 2 is a bulk-material delivery tube 5 which is of a height $h_3$ and extends over a height $h_4$ within the classifier cylinder 2. The vertical bulk-material delivery tube 5 has an upper deflection flange 6, from which a connection stub 7 leads laterally to a pneumatic bulk-material supply conduit 8. The bulk-material delivery tube 5 and/or the bulk-material supply conduit 8 may also be referred to as the "bulk-material delivery conduit".

A central tube 9 which is of a height $h_5$ is located within the classifier cylinder. The central tube 9 is fastened in the lower region of the classifier cylinder 2 by means of cross-shaped fastening webs 10. In the upper region, a conical tip 11 projects as far as the lower border of the upper deflection flange 6.

Located in the lower region of the elbow/countercurrent classifier 1 is a conical discharge hopper 12 which is of a height $h_6$ and is extended upward by a cylinder tube 13 of height $h_7$. A gas-inlet connection stub 14 is arranged laterally on the cylinder tube 13. The classifier cylinder 2 projects into the cylinder tube 13 approximately over the height $h_7$.

The cylinder tube 13 has a diameter $d_1$ which is larger than the diameter $d_2$ of the lower part 15, which is of a height $h_8$, of the classifier cylinder 2. This produces, within the cylinder tube 13, an annular duct 16 which, in its lower region, has air baffles 17 for deflecting the air which is taken in by the gas-inlet connection stub 14 and flows into the classifier cylinder 2 from the bottom in accordance with the arrows 18. This air is channeled upward in the countercurrent classifier and passes first of all into an annular duct 19 of the lower cylindrical part 15, which is of height $h_8$, of the classifier cylinder 2. Said annular duct 19 is formed by the central tube 9 which projects with a height $h_9$ into the cylindrical part 15. The annular-duct cross section is produced from the difference made up of the diameter $d_2$ of the cylinder section 15 minus the diameter $d_3$ of the central tube 9.

Above the height $h_8$ and $h_9$, the lower cylindrical section 15 tapers, via a first truncated cone 20 of height $h_{10}$ and a second truncated cone 21 of height $h_{11}$, to a second cylinder section 23 of height $h_{12}$.

Accordingly, the air stream 18 taken in in the lower part of the classifier cylinder 2 is first of all compressed in the annular duct 19 to a smaller cross section (arrows 22) before it is reduced further in cross section by the two truncated-cone sections 20, 21 and thus vastly accelerated. This produces, in the annular duct 24 formed above the truncated cone 21, a vastly accelerated air flow which serves as separating-gas stream 25. Accordingly, the two truncated-cone sections 20, 21 serve to accelerate the separating-gas stream 25 by way of their tapering cross section. The annular duct 24 of height $h_{12}$ consequently forms a cylindrical section 23 which has a diameter $d_4$ and serves as a classifying section or a separating section for the bulk material coming from the bulk-material delivery conduit 5.

The cylindrical section 23 for forming the annular duct 24 terminates just above the lower edge 26 of the bulk-material delivery tube 5, i.e. just above the opening 26 of the bulk-material stream in the classifier cylinder 2. This difference in height is designated by $h_{13}$.

The cylindrical section 23 is adjoined by a widening, third truncated cone 27 which is of height $h_{14}$, acts as an accelerating diffuser and is itself followed by a cylindrical section 28 which is of height $h_{15}$ and has a diameter $d_5$. The cylindrical section 28 has an upper termination region 29 containing the opening 4 for the passage of the bulk-material delivery tube 5. Formed between the delivery tube 5 and the cylindrical section 28 is a further annular duct 30 which opens laterally in a delivery-material outlet connection stub 31.

A narrow annular duct 32 which is of a height $h_{16}$ is formed between the central tube 9 and the bulk-material delivery tube 5, i.e. it extends from the lower opening 26 as far as the base line 33 of the conical tip 11.

Arrow 34 specifies the inflow direction, in the bulk-material delivery conduit, of the bulk-material stream supplied to the elbow/countercurrent classifier 1. The arrow 35 shows the supply of the taken-in or blown-in air quantity which is required as separating-gas stream 25 for classifying purposes. The arrow 36 illustrates the direction in which the classified fine material flows out of the delivery-material outlet connection stub 31. The coarse material cleaned of the fine material falls downward through the classifying section in the countercurrent classifier and is illustrated schematically in FIG. 1 by arrow 37.

The bottom discharge 38 of the conical discharge hopper 12 is closed by a discharge shutter 39. A cellular wheel sluice (not shown in any more detail) may also be provided. The decisive factor is that the air which is supplied or taken in is channeled through the countercurrent classifier in the vertical direction.

The gas-inlet connection stub 14 may also have a restrictor member 40 in order to be able to regulate the separating-gas stream 25 transported in the countercurrent classifier.

The opening region of the bulk-material delivery tube 5 in the classifier cylinder 2 is shown in schematic illustration in FIG. 2 and explained in more detail hereinbelow. Here, the left-hand half of the Figure shows a prior-art arrangement, while the right-hand half of the Figure relates to the innovation according to the invention. The same parts have been designated by the same references as specified in FIG. 1. In order to simplify the illustration, the truncated cone 27 has not been included. First of all, an explanation will be given of the left-hand half of the Figure in FIG. 2 as an illustration of the prior art:

The bulk material flowing into the bulk-material delivery tube 5 is divided by the conical tip 11 of the central tube 9 and passes into the annular duct 32. The annular duct 32 is formed by the lateral cylinder surface 41 of the bulk-material delivery tube 5 of diameter $d_6$, said lateral cylinder surface 41 being radially exterior to the annular duct 32, and by the lateral cylinder surface 42 of the central tube 9 of diameter $d_3$, said lateral cylinder surface 42 being radially interior to the annular duct 32. For the bulk-material stream supplied, said annular duct 32 forms an acceleration section, i.e. the air quantity in the annular gap, including the solid particles carried along, is accelerated to a velocity c, as is described in more detail in relation to the elbow, countercurrent classifier in the reference source "Verfahrenstechnik". This sets up the velocity profile 43 shown in the lefthand half of FIG. 2, i.e. the parabolic velocity profile drops toward zero at the lateral surfaces 41, 42. Consequently, heavier solid particles 48 located in the wall regions are not accelerated to the maximum velocity $c_{max.}$, but only, for example, to a velocity $c_1$ at the wall section 41 and $c_2$ at the wall section 42, these velocities $c_1$, $c_2$ not being sufficient for said heavier solid particles to pass through the separating-gas stream 25 coming from the bottom. As a result, contrary to intentions, the coarse particles 48 falling in the border region of the walls 41, 42 will not pass downward into the countercurrent classifier, but rather will pass upward into the outer annular duct 30 (arrow 44) which is intended for discharging the fine material 49, and will constitute losses. These losses of the coarse material 48 discharged with the fine material 49 are illustrated schematically by arrow 45.

Furthermore, the separating-gas stream 25 coming from the bottom also forms a velocity profile 46, which is set up in the annular duct 24 beneath the opening 26. Here too, the flow velocity $V_G$ of the separating-gas stream drops toward zero in the wall regions since the flow profile 46 drops to a pronounced extent in the direction of the wall sections. The result of this is that there is only a slight upward flow of the separating-gas stream 25, in particular, at the radially inner lateral cylinder surface 42 in the annular duct 24, this being indicated by the velocity arrow 47. The result of this is that fine material 49 falling in this near wall region of the radially inner lateral cylinder surface 42 can pass through, virtually without obstruction, the separating-gas stream 25, which is of insufficient strength at this point, and, contrary to wishes, passes into the lower region of the countercurrent classifier.

Figure 2:
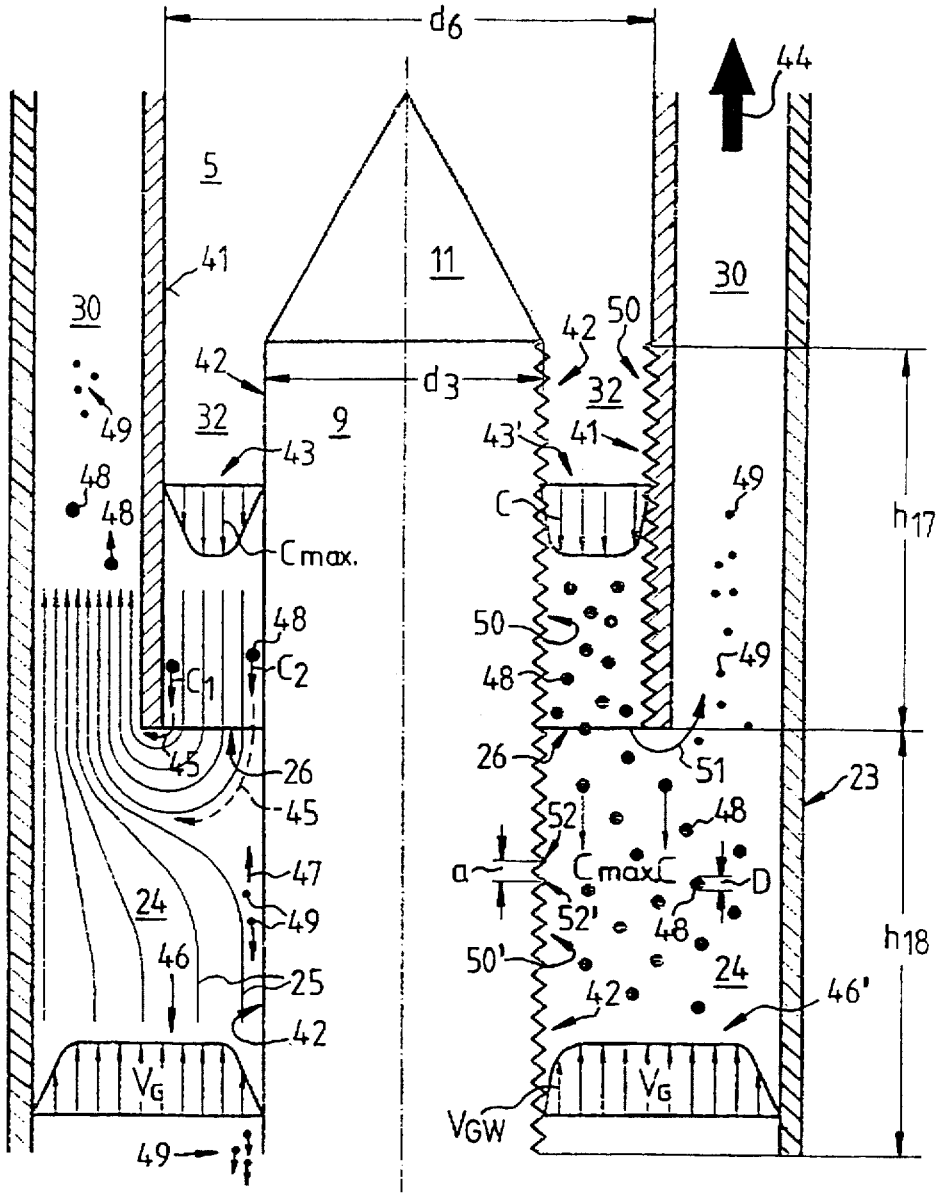

In order to counteract this disadvantage, first of all both the radially outer lateral surface 41 and the radially inner lateral surface 42 in the annular duct 32 are provided, according to the illustration on the righthand side of FIG. 2, with a surface structure 50 which results in pronounced turbulence of the air flow in these wall regions. Consequently, the velocity profile 43' does not drop to a pronounced extent toward the wall regions, but rather is in the form of a rectangle with virtually identically sized velocity vectors c even in the respective border regions. The result of this is that the entire delivery-gas quantity, including solid particles which are carried along, is brought to the necessary high velocity in the acceleration section in the annular duct 32 in order for the coarse material 48 also to have the necessary velocity $c_{max.}$ in the wall region to pass through the separating-gas stream 25 which is directed upward from the bottom. Less coarse material is thus lost.

The wall section 42, which is located beneath the opening 26 of the delivery tube 5 and belongs to the central tube 9, also has a corresponding surface structure 50', which corresponds to the surface structure 50 located above it. This also sets up, in the annular duct 24, a velocity profile 46' which is considerably steeper, in particular, in the region of the radially inner wall section 42, this being produced by corresponding turbulence. Consequently, a higher separating-gas stream velocity $V_{G-W}$ prevails in this wall region, and this prevents fine material 49 from falling downward. Therefore, according to the illustration in the right-half hand of FIG. 2, the situation where coarse material 48 is discharged with the fine material 49 into the annular duct 30 and fine material 49 is discharged into the lower region of the classifier is avoided. This considerably increases the effectiveness and the efficiency of such a classifier.

The surface structure 50, 50' may be formed as a zig-zag surface structure. In this case, the distance a between two adjacent points 52, 52' is selected such that said distance is generally smaller than the diameter D or the particle length of the solid particles 48 which form the coarse material.

The surface structure 50 may also be roughened or formed by other suitable measures in order to obtain appropriate vortices for producing turbulence. This may be, for example, a surface formed by hammer blows and having indents in the form of segments of spheres, or it may be a wave structure with pointed wave crest or the like. Other vortexing edges may also be provided.

The surface structuring 50 within the annular duct 32 preferably extends over a height section $h_{17}$, which spans the entire acceleration section, i.e. the entire annular duct 32. As a result, all the particles, even those in the border region, are subjected to the necessary acceleration for producing a desired final velocity.

In the annular duct 24 for the upwardly directed separating-gas stream 25, a turbulence-producing surface structure 50' is essentially necessary on the radially inner wall section 42, i.e. on the outer cylinder surface of the central tube 9, since this region is influenced by the delivery-material stream from the annular duct 32 located above it. The height $h_{18}$ of the roughened surface structure 50' for producing turbulence is thus selected to be of a similar order of magnitude as the height section $h_{17}$.

As can further be seen from the illustration according to FIG. 1, the gas-inlet connection stub 14 is arranged, as far as possible, in-the lower region of the elbow/countercurrent classifier 1, in order to obtain as large a section as possible for the rising separating-gas stream 18, 22, 25. Furthermore, use can be made of this section for producing an acceleration of said separating gas stream due to a diffuser action. Finally, a long section of the separating-gas stream may have the effect of subjecting fine material to secondary classification, i.e. fine material which has passed through the separating section in the annular duct 24 can still be taken up in a lower section on account of the rising countercurrent.

The invention is not restricted to the exemplary embodiment which is described and illustrated. Rather, it covers all specialist developments within the context of the patent claims.

I claim:

1. An elbow/countercurrent classifier having a cylindrical, vertically aligned classifier cylinder (2) into whose upper region a bulk-material delivery tube (5) penetrates concentrically, the latter having, at least in its lower opening region (26), an inner acceleration section (32) which is in the form of an annular duct and is intended for the bulk-material stream transported by means of a delivery gas, the delivery-gas stream having directed counter to it, in the form of an annular duct, a separating-gas stream which is directed upward from the bottom and serves to separate the bulk-material stream into lighter and heavier constituent parts, and it being possible for the lighter constituent parts (fine material 49) to be transported upward out of the classifier cylinder (2) through an annular duct (30) which encloses the bulk-material delivery tube (5), while heavier bulk-material elements (coarse material 48) pass through the separating-gas stream (25) and pass downward into the classifier cylinder (2), wherein at least the radially inner lateral cylinder surface (42) of the acceleration section (32) in the form of an annular duct has, at least in the lower opening region (26) of the bulk-material delivery tube (5), a surface structure (50) and/or at least the radially inner lateral cylinder surface (42) of the annular duct (24) channeling the separating-gas stream (25) has a surface structure (50'), the surface structure (50, 50') resulting in increased turbulence and thus in an increase in velocity of the respective air flow at the respective wall section.

2. The elbow/countercurrent classifier as claimed in claim 1, wherein the radially inner (42) and the radially outer (41) lateral cylinder surfaces of the annular acceleration duct (32) in the bulk-material delivery tube (5) have a surface structure (50) which is formed as surface roughening and results in increased turbulence of the bulk-material delivery gas in the wall region.

3. The elbow/countercurrent classifier as claimed in claim 1, wherein the annular acceleration section (32) in the bulk-material delivery tube (5) and the flow section (24) which is in the form of an annular duct and is intended for the separating-gas stream (25) are formed by a central tube (9) arranged concentrically in the classifier cylinder (2) and have, in particular, a conical tip (11).

4. The elbow/countercurrent classifier as claimed in claim 3, wherein, at least in the region of the opening (26) of the bulk-material delivery tube (5) into the classifier cylinder (2), the central tube (9) has an upwardly and downwardly extending wall section (42) of height $h_{17}$, $h_{18}$ which comprises a surface structure (50, 50') for producing increased air-flow turbulence and thus increased particle velocities.

5. The elbow/countercurrent classifier as claimed in claim 1, wherein the surface structure (50, 50') for producing increased air-flow turbulence is formed as zig-zag surface roughening, the distance a between two adjacent points (52, 52') being smaller than the largest diameter D or particle length of the coarse-material fraction (48).

6. The elbow/countercurrent classifier as claimed in claim 1, wherein, in cross section, the surface structure is formed as a wave structure with pointed wave crest.

7. The elbow/countercurrent classifier as claimed in claim 1, wherein the surface structure has vortexing edges.

8. The elbow/countercurrent classifier as claimed, in particular, in claim 1, wherein, in order to form a secondary classifying section, the radial inlet opening (14) for the separating-gas stream (25) is arranged in the lower region of the countercurrent classifier.

9. The elbow/countercurrent classifier as claimed in claim 1, wherein, in its lower region, the classifier cylinder (2) has a discharge hopper (12) with a cylinder section (13) which is continued upward and has, at the side, a radially running gas-inlet connection stub (14) for the separating-gas stream, and wherein the separating-gas stream can be deflected into the classifier cylinder (2) via air baffles (17).

10. The elbow/countercurrent classifier as claimed in claim 1, wherein the conical discharge hopper (12) has a closable discharge opening (38).

11. The elbow/countercurrent classifier as claimed in claim 1, wherein the gas-inlet connection stub (14) is assigned a restrictor member (40).

* * * * *